US008672125B2

(12) United States Patent
Sween et al.

(10) Patent No.: US 8,672,125 B2
(45) Date of Patent: Mar. 18, 2014

(54) CUSHTOP LAPTOP STANDS AND METHODS OF MANUFACTURE THEREOF

(75) Inventors: Barry Sween, Santa Monica, CA (US); Mike Simonian, San Francisco, CA (US); Maaike Evers, San Francisco, CA (US)

(73) Assignee: Belkin International, Inc., Playa Vista, CA (US)

( * ) Notice: Subject to any disclaimer, the term of this patent is extended or adjusted under 35 U.S.C. 154(b) by 496 days.

(21) Appl. No.: 12/184,830

(22) Filed: Aug. 1, 2008

(65) Prior Publication Data

US 2009/0032667 A1 Feb. 5, 2009

Related U.S. Application Data

(60) Provisional application No. 60/953,445, filed on Aug. 1, 2007.

(51) Int. Cl.
*B65D 85/00* (2006.01)

(52) U.S. Cl.
USPC ..... 206/320; 206/523; 248/176.1

(58) Field of Classification Search
USPC ..... 206/320, 523; 5/639, 645; D14/447; D6/406.4, 419; 248/176.1, 918, 457
See application file for complete search history.

(56) References Cited

U.S. PATENT DOCUMENTS 2,848,149 A * 8/1958 Ward ..... 248/146
5,143,341 A * 9/1992 Juster ..... 248/444
5,217,119 A 6/1993 Hollingsworth
5,725,189 A * 3/1998 Landy ..... 248/205.2
5,871,094 A 2/1999 Leibowitz
5,887,723 A * 3/1999 Myles et al. ..... 206/320
6,267,236 B1 * 7/2001 Seok ..... 206/320
6,305,652 B1 10/2001 Borke et al.

(Continued)

FOREIGN PATENT DOCUMENTS

TW 562182 11/2003

OTHER PUBLICATIONS

CushTop; http://www.belkin.com/laptopathome/cushtop; dated Jun. 15, 2007; 1 page.

(Continued)

*Primary Examiner* — Andrew Perreault
(74) *Attorney, Agent, or Firm* — Bryan Cave LLP

(57) ABSTRACT

Embodiments of cushtop laptop stands and methods of manufacture thereof are generally described herein. An article to support a device comprises a first portion having a first interior surface and a first exterior surface, a second portion having a second interior surface and a second exterior surface, and a third portion configured to couple together the first portion and the second portion. At least one of the first, second, and third portions comprises a cushioning material. In a first configuration, the article comprises a first end of the first interior surface spaced apart from a first end of the second interior surface by a first distance, and a second end of the first interior surface spaced apart from a second end of the second interior surface by a second distance greater than the first distance. In a second configuration, the article comprises the first end of the first interior surface spaced apart from the first end of the second interior surface by a third distance substantially equal to a thickness of the device. Other embodiments may be described and claimed.

32 Claims, 11 Drawing Sheets

(56) References Cited

U.S. PATENT DOCUMENTS

| | | | | |
|---|---|---|---|---|
| 6,781,833 | B2 | 8/2004 | Lu | |
| D522,002 | S | 5/2006 | Cheng | |
| 2002/0117879 | A1 | 8/2002 | Goodson | |
| 2003/0058615 | A1 | 3/2003 | Becker et al. | |
| 2004/0188289 | A1 | 9/2004 | Woo | |
| 2005/0083650 | A1 | 4/2005 | Yang | |
| 2006/0285283 | A1* | 12/2006 | Simonian et al. | 206/305 |
| 2008/0142663 | A1 | 6/2008 | Wright et al. | |

OTHER PUBLICATIONS

VAIO; VGP-VST1; http://www.ecat.sony.co.jp/vaio/acc/acc.cfm?PD=26608; dated May 31, 2007; 3 pages.

Belkin: CushTop Hideaway; http://catalog.belkin.com/IWCatProductPage.process?Product_Id=459905; dated Jul. 31, 2008; 1 page.

International Search Report; Application No. PCT/US 08/72000; 9 pages, Search report date: Sep. 24, 2008.

* cited by examiner

CUSHTOP LAPTOP STANDS AND METHODS OF MANUFACTURE THEREOF

CROSS REFERENCE TO RELATED APPLICATIONS

This application is a non-provisional application claiming priority to U.S. Provisional Patent Application No. 60/953,445, filed Aug. 1, 2007, which is incorporated herein by reference.

TECHNICAL FIELD

This disclosure generally relates to an article to support a device, and more specifically, relates to a cushioned article to support and/or store an electronic device such as a laptop computer.

BACKGROUND

Laptop computers have long been used to conveniently allow a user the advantage of operating their computer in a mobile fashion, and apart from the constraints of a desktop. As the name suggests, laptop computers are often operated by a user on the user's lap in an out-of-office environment. The compact nature and mobility of the laptop computer provides the user with the ability to operate their computer, for example, during travel, in an outside environment, while sitting in a chair, and the like. However, due to the nature of most large articles, such as a laptop computer, extended periods of maintaining the article on the user's lap may be uncomfortable. A cushioned computer laptop pad can alleviate such discomfort. Furthermore, a cushioned computer laptop pad that can also serve as a compact, protective storage unit is likewise desirable.

Figure 1:
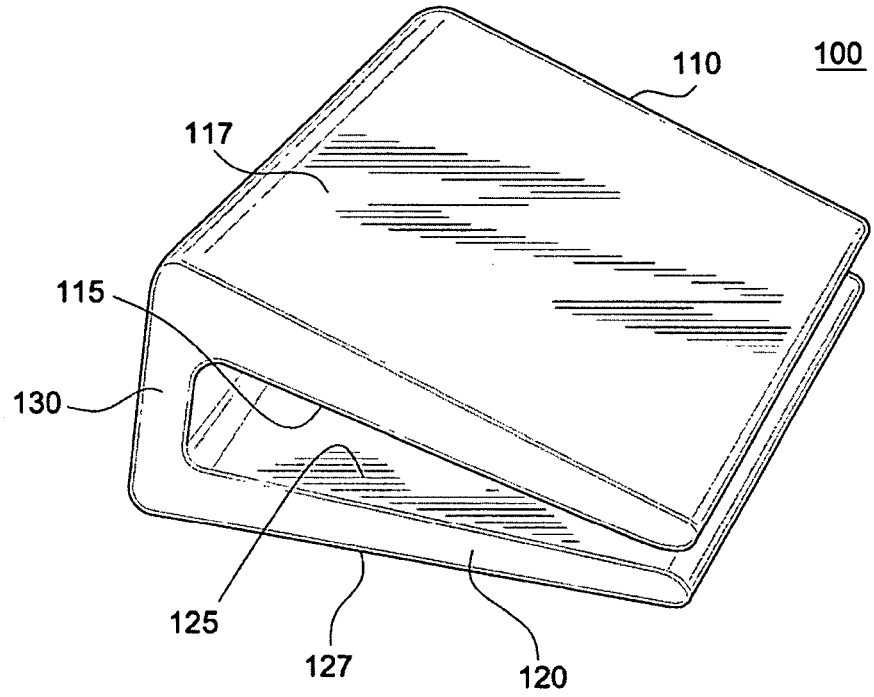
FIG. 1 illustrates an isometric view of an exemplary cushtop laptop stand according to a first embodiment of the invention.

For simplicity and clarity of illustration, the drawing figures illustrate the general manner of construction, and descriptions and details of well-known features and techniques may be omitted to avoid unnecessarily obscuring the cushtop laptop stand. Additionally, elements in the drawing figures are not necessarily drawn to scale. For example, the dimensions of some of the elements in the figures may be exaggerated relative to other elements to help improve understanding of embodiments of the cushtop laptop stand and their methods of manufacture. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of cushtop laptop stands and their methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of cushtop laptop stands and their methods of manufacture described herein are, for example, capable of operation in other orientations than those illustrated or otherwise described herein. The term "coupled," as used herein, is defined as directly or indirectly connected in a physical, mechanical, or other manner.

DESCRIPTION OF EXAMPLES OF EMBODIMENTS

In a first embodiment of a cushtop laptop stand, an article to support a device comprises a first portion having a first interior surface and a first exterior surface, a second portion having a second interior surface and a second exterior surface, and a third portion configured to couple together the first portion and the second portion. At least one of the first, second, and third portions comprises a cushioning material. In a first configuration, the article comprises a first end of the first interior surface spaced apart from a first end of the second interior surface by a first distance, and a second end of the first interior surface spaced apart from a second end of the second interior surface by a second distance greater than the first distance. In a second configuration, the article comprises the first end of the first interior surface spaced apart from the first end of the second interior surface by a third distance substantially equal to a thickness of the device. Other examples, embodiments, and related methods are further described below.

Turning now to the figures, in a first embodiment of the cushtop laptop stand, and with reference to FIG. 1, an article 100 to support a device 380 (FIG. 3) comprises a cushioning portion 110 having an interior surface 115 and an exterior surface 117. Article 100 further comprises a cushioning portion 120 having an interior surface 125 and an exterior surface 127. Article 100 also comprises a cushioning portion 130 coupling together cushioning portion 110 and cushioning portion 120. Cushioning portions 110 and 120 can be symmetrical with each other. In the present embodiment, one or more of cushioning portions 110, 120, and 130 can comprise cushioning material.

Figure 2:
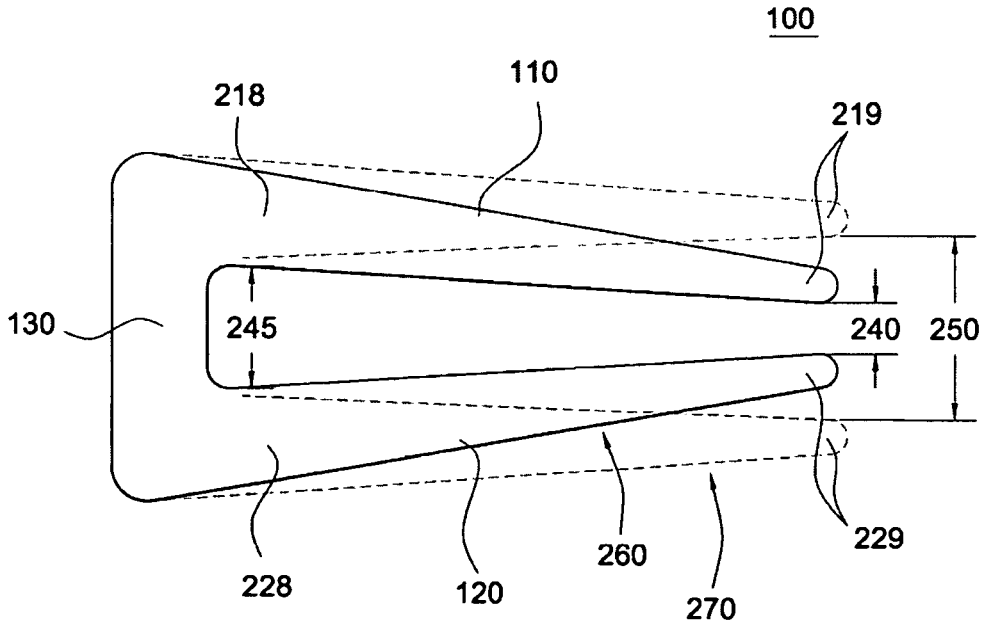
FIG. 2 illustrates an side view of the exemplary cushtop laptop stand of FIG. 1.

With reference to FIG. 2, article 100 in a configuration 260 comprises an end 219 of cushioning portion 110 spaced apart from an end 229 of cushioning portion 120 by a distance 240, and an end 218 of cushioning portion 110 spaced apart from an end 228 of cushioning portion 120 by a distance 245 greater than distance 240. Configuration 260 can be referred to as a "resting," non-stressed, or non-deformed position of article 100. In a configuration 270, illustrated by the dashed lines in FIG. 2, article 100 comprises end 219 of cushioning portion 110 spaced apart from end 229 of cushioning portion 120 by a distance 250 substantially equal to a thickness of device 380 (FIG. 3) and greater than distance 240. Distance 250 can be greater, less than, or equal to distance 245.

In this exemplary embodiment, distance 240 is shown as comprising at least some discrete distance that is less than distance 245, but in a different embodiment, distance 240 may equal zero, i.e., end 219 and end 229 may contact one another.

Figure 3:
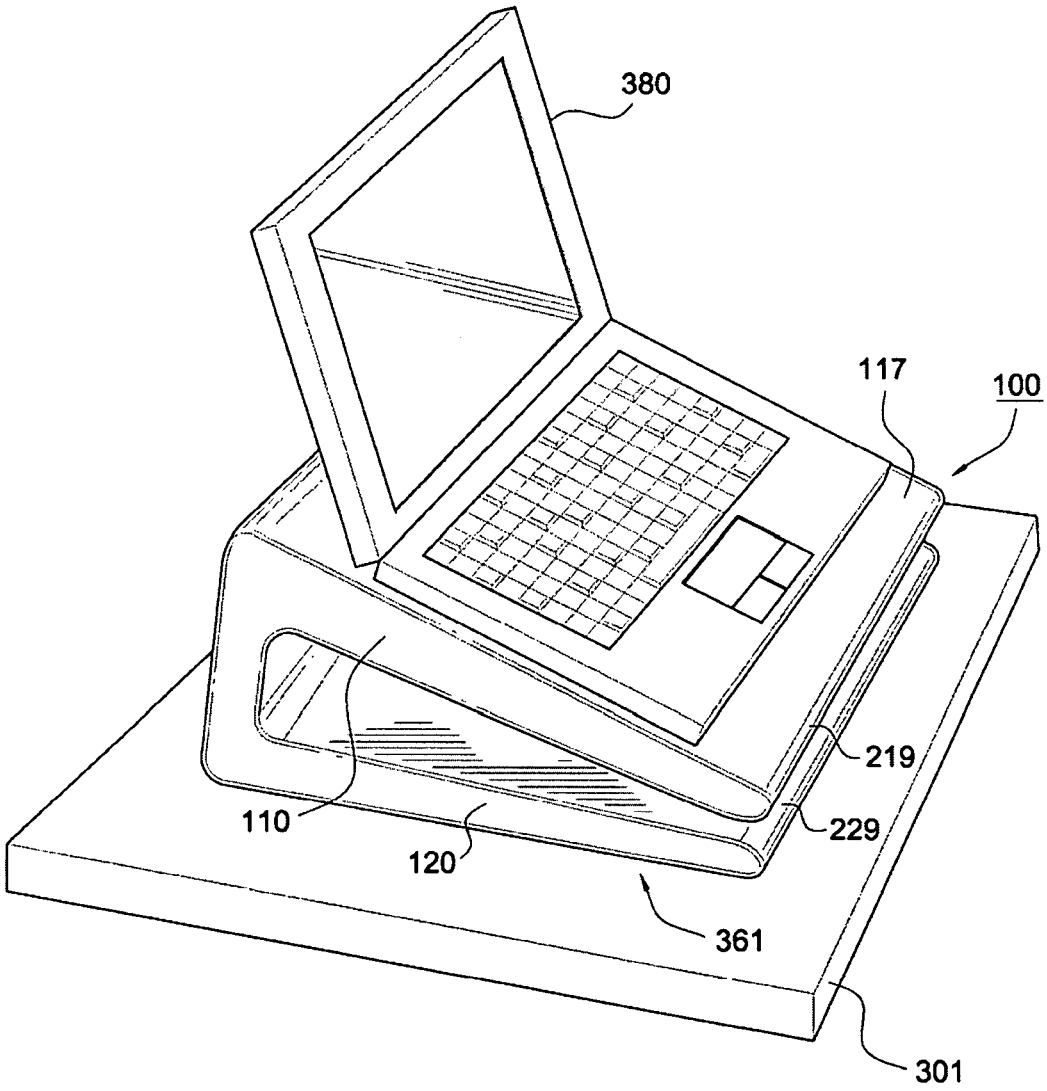
FIG. 3 illustrates an isometric view of the exemplary cushtop laptop stand of FIG. 1 supporting a laptop computer.

Turning now to FIG. 3, article 100 is shown in a configuration 361 comprising a substantially horizontal position relative support surface 301. In some examples, support surface 301 can comprise a floor, a tabletop, and/or the lap of a sitting individual. In configuration 361, device 380, such as a laptop computer, is shown as supported by article 100 over exterior surface 117. As shown in FIG. 3, ends 219 and 229 can contact each other or at least move closer to each other from the "resting" position due to the weight of device 380 on article 100.

Figure 4:
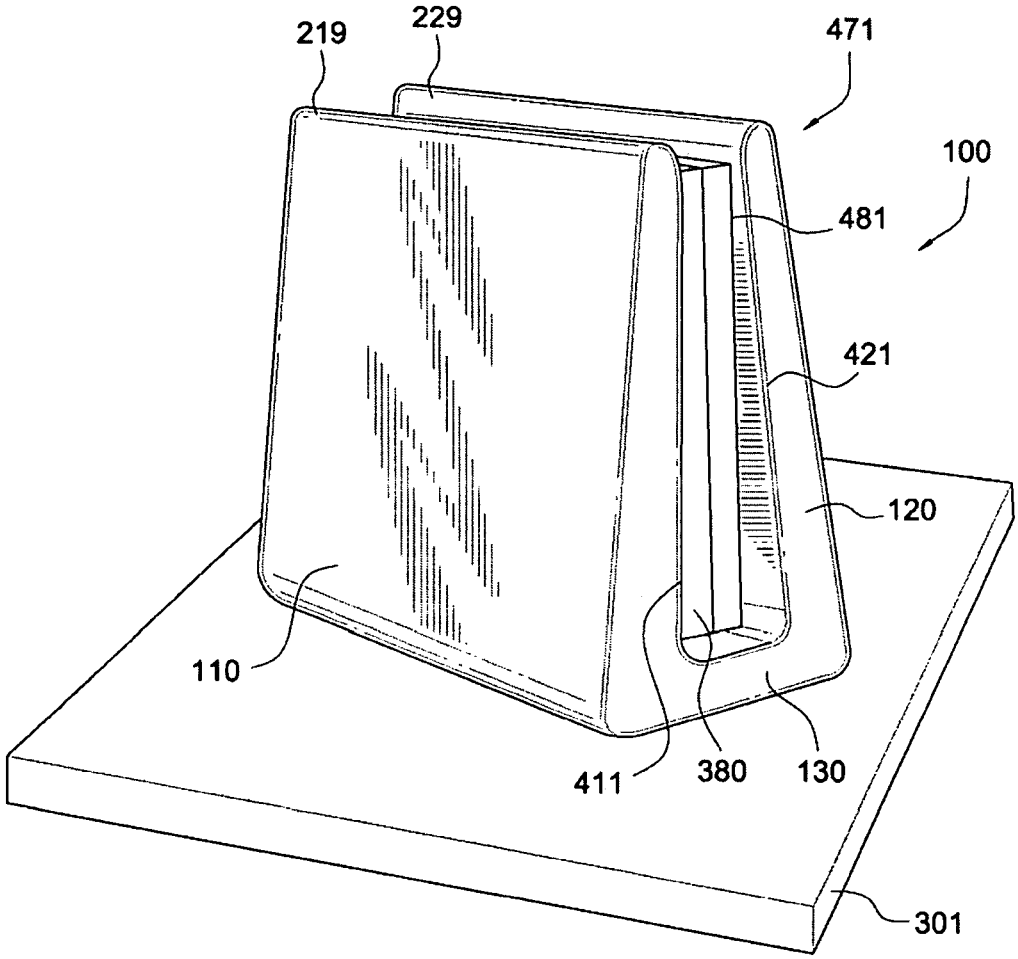
FIG. 4 illustrates an isometric view of the exemplary cushtop laptop stand of FIG. 1 storing a laptop computer.

With reference to FIG. 4, a configuration 471 of article 100 comprises a substantially perpendicular position relative to configuration 361 (FIG. 3). In the present embodiment, article 100 comprises an inner perimeter 411 of portion 110 comprising a perimeter at least as great as an outer perimeter 481 of device 380, such that perimeter 411 of portion 110 extends to at least perimeter 481 of device 380. Also, an inner perimeter 421 of portion 120 comprises a perimeter at least as great as outer perimeter 481 of device 380, such that inner perimeter 421 of portion 120 extends to at least outer perimeter 481 of device 380.

In the present exemplary embodiment, the cushioning material of article 100 facilitates portion 130 (and, in some embodiments, portions 110 and/or 120) to flex via a deformation of the generally elastic foam or other pliable material used to manufacture portions 110, 120, and/or 130. The deformation may comprise compressive, tensile, shear, torsional, and/or other forces. Therefore, portion 130 can serve as a hinge such that end 219 of cushioning portion 110 can become spaced apart from end 229 of cushioning portion 120. This spacing facilitates positioning device 380 between cushioning portion 110 and cushioning portion 120 (FIG. 4). Device 380 can contact portion 130 or may be supported by cushioning portions 110 and 120 above portion 130. The spacing between ends 219 and 229 at a "resting" position of article 100 can be less than or at least equal to the spacing between ends 219 and 229 when device 380 is located within article 100, as illustrated in FIG. 4.

With continued reference to FIG. 4, article 100 in configuration 471 provides a storage function for device 380, where no leaning or lateral support may be needed. Thus, article 100 can function as a stand-alone upright article, thereby providing for a greater variety of storing options. Moreover, because of the minimal footprint of configuration 471, article 100 requires less "floor" space than if article 100 were laid in configuration 361 (FIG. 3). Such minimal footprint provides beneficial storage where space is at a premium such as college dormitories, military barracks, office cubicles, small apartments, and the like. In addition, this exemplary embodiment of article 100 may provide a concealment function during storage.

Figure 5:
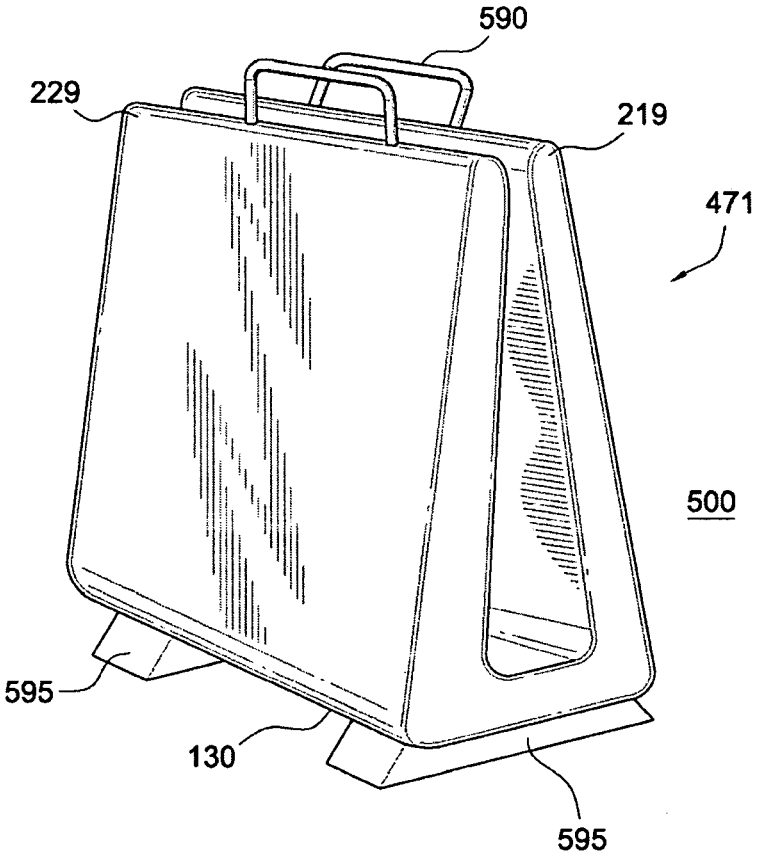
FIG. 5 illustrates an isometric view of an exemplary cushtop laptop stand according to a second embodiment of the invention.

Turning to the next figure, FIG. 5 illustrates an isometric view of an article 500, which can be similar to article 100 of FIGS. 1-4. Article 500 is in configuration 471 and may comprise elements beyond those described for article 100 (FIGS. 1-4) to supplement the functionality of article 100. For example, article 500 may further comprise one or more handles 590 coupled proximate to ends 219, 229, 218 and/or 228 to facilitate transporting article 500. Moreover, article 500 may further comprise at least one support 595 coupled to an exterior portion of portion 130 to further support article 500 upright in configuration 471.

Figure 6:
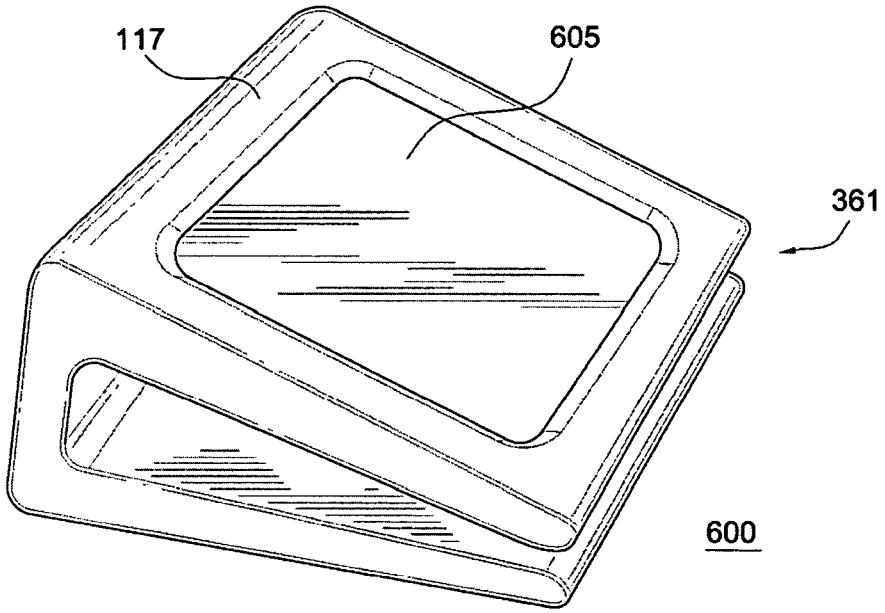
FIG. 6 illustrates an isometric view of an exemplary cushtop laptop stand according to a third embodiment of the invention.

FIG. 6 illustrates an isometric view of an article 600 in configuration 361, which can also be similar to article 100 of FIGS. 1-4 and article 500 of FIG. 5. Exterior surface 117 of article 600 may further comprise a minor or limited recess portion 605 that has a contour or perimeter matching or complementing perimeter 481 (FIG. 4) of device 380 (FIGS. 3 and 4). In this exemplary embodiment, device 380 may be further secured within recess 605, thereby restricting any unwanted movement during use of device 380 on article 600 in configuration 361.

Figure 7:
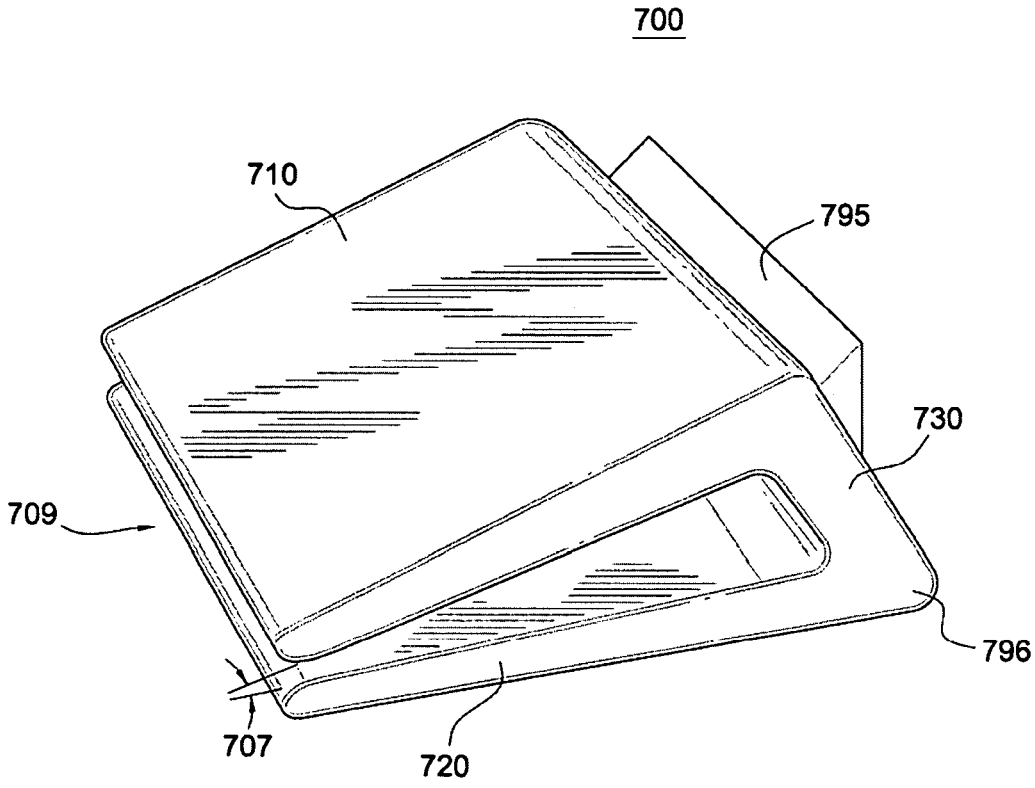
FIG. 7 illustrates an isometric view of an exemplary cushtop laptop stand according to a fourth embodiment of the invention.
Figure 8:
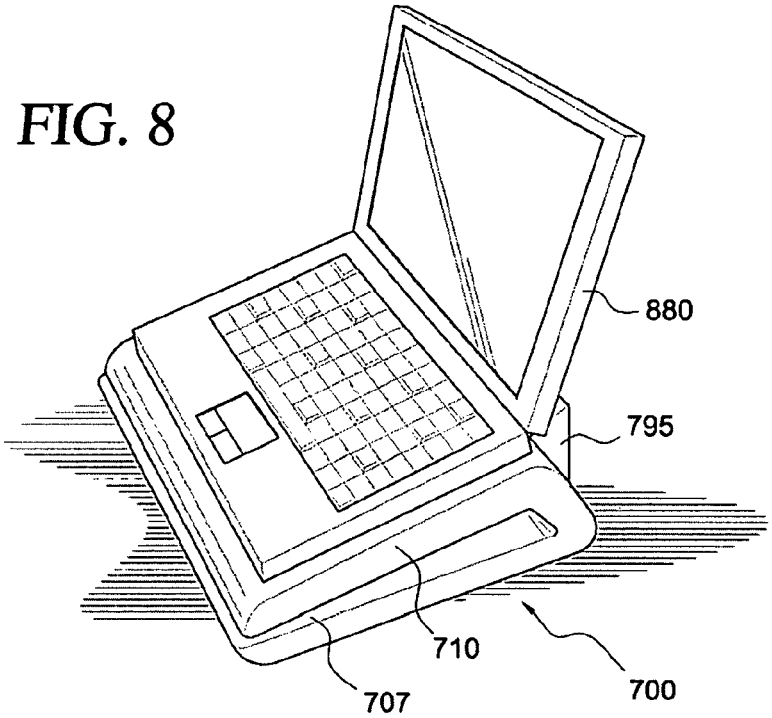
FIG. 8 illustrates an isometric view of the exemplary cushtop laptop stand of FIG. 7 supporting a laptop computer.
Figure 9:
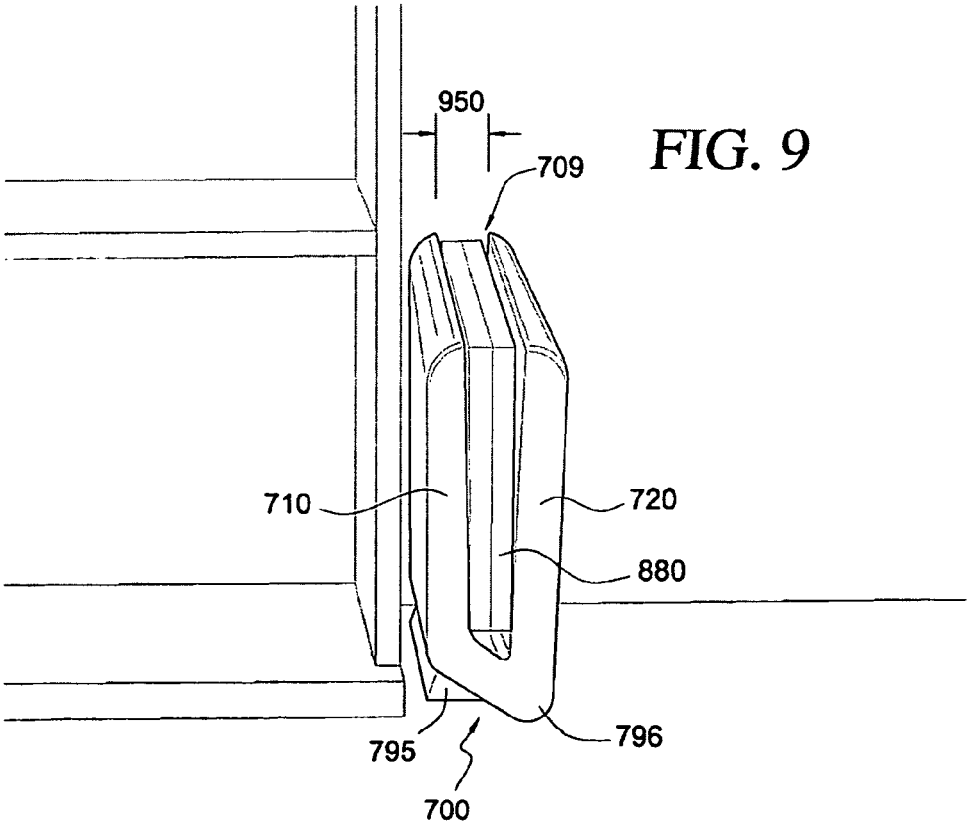
FIG. 9 illustrates an isometric view of the exemplary cushtop laptop stand of FIG. 7 storing a laptop computer.

Continuing with the figures, FIG. 7 illustrates an isometric view of an article 700, which can also be similar to article 100 of FIGS. 1-4, article 500 of FIG. 5, and article 600 of FIG. 6. FIG. 8 illustrates a view of article 700 in use with a device 880. FIG. 9 illustrates a view of article 700 in storage with device 880.

Article 700 includes a portion 710 and a portion 720 substantially opposite portion 710. Similar to the exemplary embodiment described herein with reference to FIGS. 1-4, first portion 710 and/or second portion 720 comprises one or more cushioning materials. In the embodiment of FIG. 7, a hinge 730 couples portion 710 to portion 720 at first ends 731 of article 700. In some embodiments, hinge 730 can be similar to portion 130 of article 100 (FIGS. 1-4). In this exemplary embodiment, hinge 730 separates portion 710 from portion 720, which results in an acute angle 707 between portion 710 and portion 720 at and end 709 of article 700. As shown with reference to FIG. 8, acute angle 707 can facilitate supporting and providing a viewing angle for a device 880, such as a laptop computer. Additionally, and with reference to FIG. 9, article 700 may be spaced apart at second end 709 at least a distance 950 of a thickness of device 880 to allow device 880 to be positioned between portion 710 and portion 720 for storage.

Back to FIG. 7, article 700 further comprises a portion 795 proximate to portion 710, and coupled to hinge 730. Portion 795, along with an edge 796 of portion 730, can provide support for article 700 in the vertical position illustrated in FIG. 9. In the exemplary embodiment viewed in FIG. 8, when article 700 is in the horizontal position, portion 795 may also provide a "back stop" type function to prevent device 880 from sliding off of a rear of portion 710 when article 700 supports device 880 during use of device 880.

Figure 11:
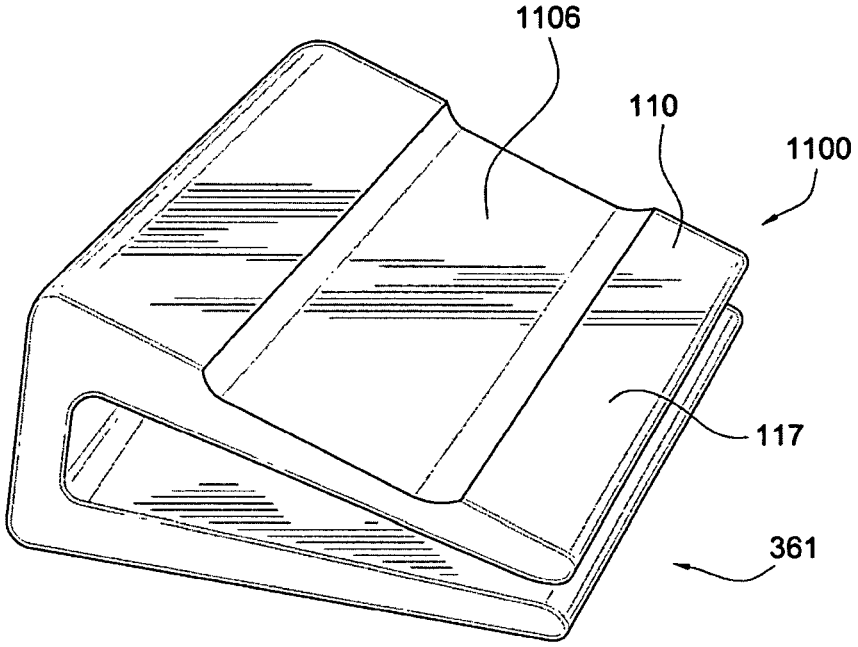
FIG. 11 illustrates an isometric view of an exemplary cushtop laptop stand according to a fifth embodiment of the invention.

Skipping to FIG. 11, an article 1100 is illustrated in a horizontal position. Article 1100 can be similar to article 100 of FIGS. 1-4, article 500 of FIG. 5, article 600 of FIG. 6, and article 700 of FIGS. 7-9. Article 1100 comprises a recess or trough 1106 as part of exterior portion 117. In this exemplary embodiment, device 380 (FIG. 3) may be placed on or over exterior portion 117 when article 1100 is in configuration 361 such that device 380 straddles or is located over and not in trough 1106, thereby creating a gap between the bottom of device 380 and the bottom of recessed trough 1106. In this configuration, air may flow freely through the gap, thereby providing a cooling function to device 380. Additionally, trough 116 and/or other sections of portion 110 can have holes for the same purpose.

Among the various exemplary embodiments described herein, the cushioning material can comprise a foam-like material such as a closed cell urethane to provide the cushioning function. Other exemplary embodiments, however, may comprise other materials that can provide the cushioning function. For example, other foams, which may include open cell or closed cell configurations, other polymers, rubbers, and the like may be used. Moreover, instead of a cushioning material, other contemplated embodiments may comprise a bladder that may further comprise a filler, such as, a gas, a liquid, a gel, a polymer, and the like, to likewise provide cushioning. An exemplary embodiment such as a bladder, may further provide other advantages such as compact storage when not in use. In such an exemplary embodiment, the bladder, when void of the filler, may be folded for easy storage and transportation.

Among the various embodiments described herein, the cushioning material comprises semi-rigid or semi-flexible characteristics. For example, the cushioning material may be flexible enough to pry apart the first and second portions 110 and 120 (FIGS. 1-4) to allow insertion of a laptop computer between them, as shown in FIGS. 4 and 9, but rigid enough such that the spacing between the first and second portions 110 and 120 toward the coupled or hinged ends 218 and 228 (FIG. 2) does not significantly sag or collapse from the weight of a laptop computer when the article is used as a support in the horizontal position, as shown in FIGS. 3 and 8.

As shown among the various figures, to article 100 of FIGS. 1-4, article 500 of FIG. 5, article 600 of FIG. 6, article 700 of FIGS. 7-9, and article 1100 of FIG. 11 all comprise substantially planar portions similar to portions 110 and 120 (FIGS. 1-4). Other exemplary embodiments, however, are contemplated having other size and shape configurations. For example, other embodiments may comprise different sizes to accommodate different size computers, or different sizes may be used to accommodate different individual users, such as, one size for adults and another size for children. Also, other shape configurations may be used to accommodate the various aesthetic preferences among users. In other exemplary embodiments the cushioning material may be covered with fabric and/or other finishing and design elements.

Figure 12:
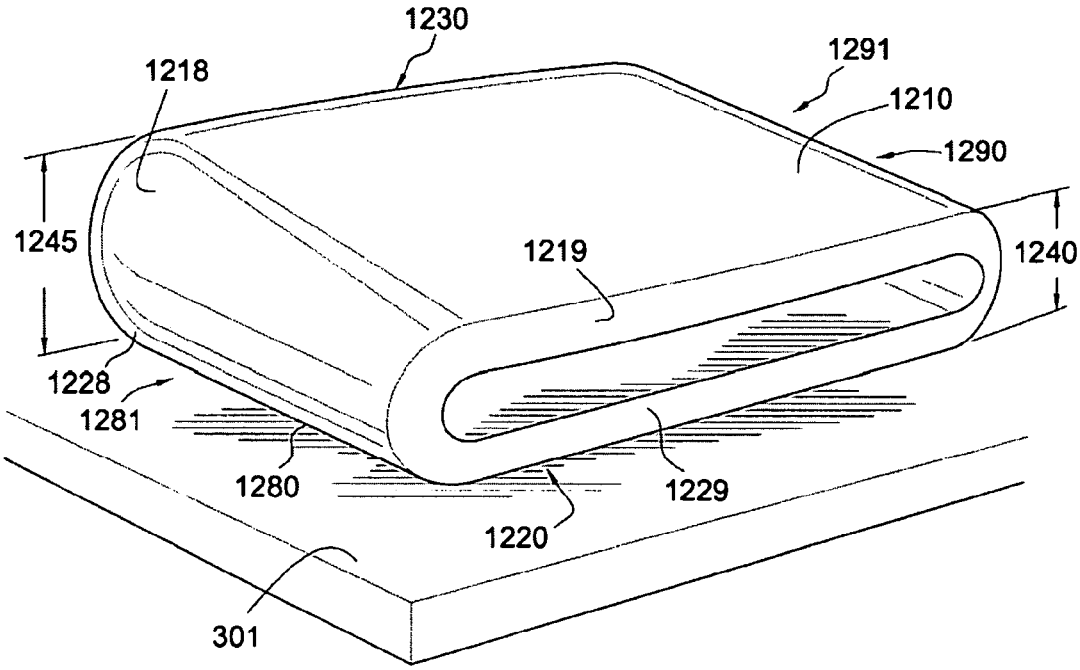
FIGS. 12, and 13 illustrate isometric views of an exemplary cushtop laptop stand according to a sixth embodiment of the invention.

Skipping ahead, FIG. 12 illustrates an isometric view of article 1200, which can be similar to article 100 of FIGS. 1-4, article 500 of FIG. 5, article 600 of FIG. 6, and article 7 of FIGS. 7-9.

Article 1200 comprises portions 1210, and 1220, similar to portions 110, and 120 of article 100 (FIGS. 1-4). In the present embodiment, article 1200 also comprises portion 1230, similar to portion 130 of article 100 (FIGS. 1-4). In addition, article 1200 comprises portion 1280 coupled between portions 1210 and 1220 at lateral end 1281 of article 1200. Article 1200 also comprises portion 1290 coupled between portions 1210 and 1220 at lateral end 1291 of article 1200. In the same or a different embodiment, portions 1280 and 1290 can be comprised of respective ends of portions 1210 and 1220 coupled together at lateral ends 1281 and/or 1291. Portions 1280 and 1290 can comprise cushioning material that is similar to the material used for portions 110 and 120 (FIGS. 1-4).

In the present embodiment, distance 1240 separates at least a part of end 1219 of portion 1210 from a part of end 1229 of portion 1220. Similarly, distance 45 separates at least a part of end 1218 of portion 1210 from a part of end 1228 of portion 1220. Distance 1245 is greater than distance 1240, thereby creating in article 1200 a slope that can facilitate a typing or support position when a device like device 380 (FIG. 13) is supported over one of portions 1210 or 1220.

Figure 13:
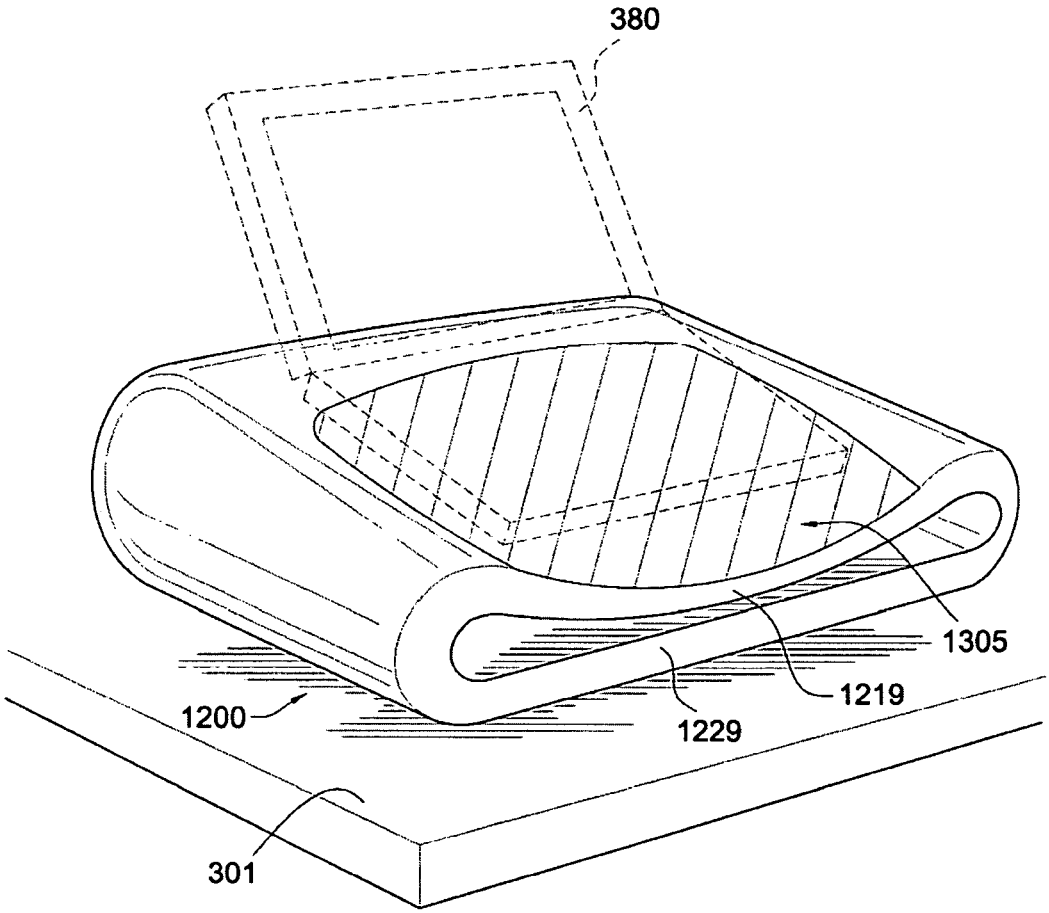

In one configuration, as illustrated in FIG. 12, article 1200 can comprise a position substantially parallel to support surface 301, and is capable of supporting a device 380 (FIG. 13) similar to the manner described for articles 100 and 700 in FIGS. 3 and 8, respectively. In one embodiment, end 1219 flexes uniformly towards portion 1229 when supporting device 380, similar to the flexing of portions 219 and 229 of article 100 (FIGS. 1-4). In a different embodiment, as shown in FIG. 13, a control portion of end 1219 can flex towards a portion of end 1229 while article 1200 supports device 380, such that distance 1240 varies from one site of ends 1219 and 1229 to the opposite side of ends 1219 and 1229. In the same embodiment, a non-uniform depression 1305 can be formed by the weight of device 380 bearing down on portion 1210. In some embodiments, depression 1305 can facilitate venting between device 380 and portion 1210 of article 1200.

In a different configuration, article 1200 can stand in a substantially upright, normal or vertical, relative to support surface 301, being capable of accommodating device 380 similar to as described for articles 100 and 700 in FIGS. 4 and 9, respectively. In some embodiments, the pocket formed between portions 1210, 1220, 1230, 1280, and 1290 of article 1200 can be large enough to accommodate accessories related to device 380, such as peripherals, batteries, and/or power adapters, in addition to device 380. In the same or a different embodiment, the pocket can comprise subpockets configured to accommodate such accessories.

Figure 10:
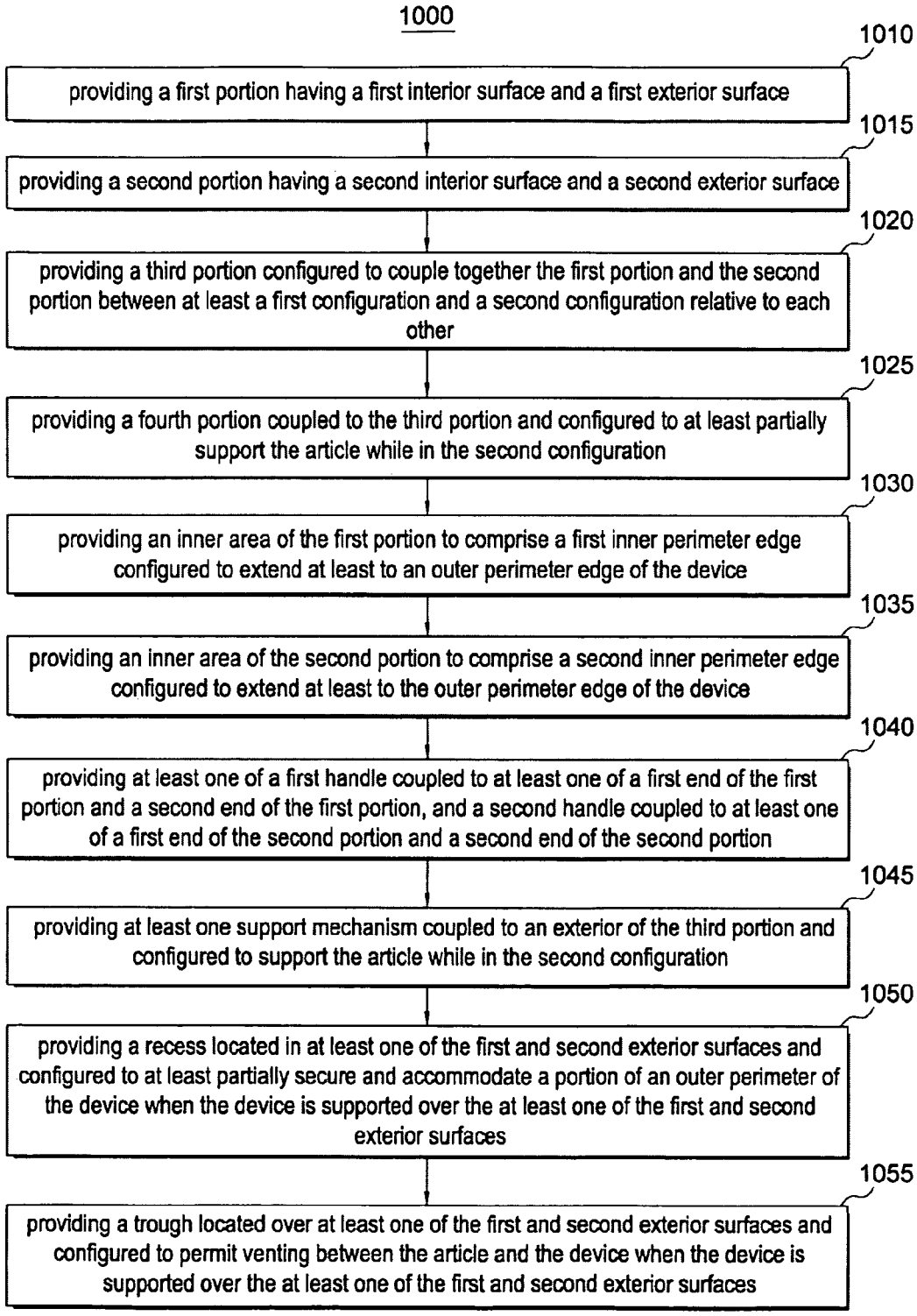
FIG. 10 depicts a flow diagram representation of a manner in which a cushtop laptop stand may be manufactured, according to an embodiment.

Turning now to FIG. 10, a method 1000 to manufacture a cushtop laptop stand comprises the steps of: providing a first portion having a first interior surface and a first exterior surface (block 1010), providing a second portion having a second interior surface and a second exterior surface (block 1015) and providing a third portion configured to couple together the first portion and the second portion between at least a first configuration and a second configuration relative to each other (block 1020). In some embodiments, method 1000 can encompass manufacturing and/or designing activities.

In some embodiments, a sub-block of one or more of blocks 1010, 1015, and 1020 can comprise providing a cushioning material for one or more of the first, second, and third portions. In at least some embodiments, first and second portions are substantially planar. In the same or a different embodiment, the while in the first configuration, the article comprises a first end of the first interior surface spaced apart from a first end of the second interior surface by a first distance; and a second end of the first interior surface spaced apart from a second end of the second interior surface by a second distance greater than the first distance. In the same or a different embodiment, while in the second configuration, the article comprises the first end of the first interior surface spaced apart from the first end of the second interior surface by a third distance substantially equal to a thickness of the device. In some embodiments, the first configuration comprises a substantially horizontal position relative to the lap of a sitting individual, and the second configuration comprises a substantially perpendicular position relative to the first configuration.

Method 1000 can further comprise providing a fourth portion coupled to the third portion and proximate to at least one of the first exterior surface and the second exterior surface, wherein the fourth portion is configured to at least partially support the article while in the second configuration (block 1025). In addition, method 1000 can also comprise providing an inner area of the first portion to comprise a first inner perimeter edge configured to extend at least to an outer perimeter edge of the device (block 1030) and providing an inner area of the second portion to comprise a second inner perimeter edge configured to extend at least to the outer perimeter edge of the device (block 1035).

In some examples, method 1000 can further comprise at least one of providing a first handle coupled to at least one of a first end of the first portion and a second end of the first portion, and providing a second handle coupled to at least one of a first end of the second portion and a second end of the second portion (block 1040). In the same or different examples, method 1000 can further comprise providing at least one support mechanism coupled to an exterior of the third portion and configured to support the article while in the second configuration (block 1045).

Method 1000 can comprise in some embodiments providing a recess located in at least one of the first and second exterior surfaces, wherein the recess is configured to at least partially secure and accommodate a portion of an outer perimeter of the device when the device is supported over the at least one of the first and second exterior surfaces (block 1050). In the same or a different embodiment, method 1000 can comprise providing a trough located in at least one of the first and second exterior surfaces, wherein the trough is configured permit venting between the article and the device when the device is supported over the at least one of the first and second exterior surfaces.

Although a particular order is illustrated for the blocks shown in FIG. 10, these blocks may be performed in other temporal sequences. At least some of the blocks depicted in FIG. 10 may be performed sequentially, concurrently, in reverse order, or the like. Some of the blocks may also be optional. For example, block 1025 can be optional, or can performed before or after blocks 1030, 1035, and/or 1040. Block 1025 can also be performed before of after blocks 1030, 1035, 1040, 1045, 1050, and/or 1055. As an additional example, block 1035 can be performed before or after blocks 1025, 1030, 1040, and/or 1050. Other variations are also contemplated herein.

Additional examples of similar or other implementations have been given in the foregoing description. Accordingly, the disclosure of embodiments of cushtop laptop stands and methods of manufacture thereof is intended to be illustrative of the scope of cushtop laptop stands and their methods of manufacture, and is not intended to be limiting. For example, in one embodiment, a cushtop laptop stand may have one or more features of FIGS. 5 and/or 11, with or without the features described with reference to FIG. 6. Other permutations of the different embodiments having one or more of the features of the various figures are likewise contemplated. It is intended that the scope of such cushtop laptop stands and their methods of manufacture shall be limited only to the extent required by the appended claims.

The cushtop laptop stands and methods of manufacture thereof discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment of the cushtop laptop stands and methods of manufacture thereof, and may disclose alternative embodiments of cushtop laptop stands and their methods of manufacture.

All elements claimed in any particular claim are essential to the cushtop laptop stands and/or methods of manufacture thereof claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. An article to support a device, the article comprising:

a first portion having a first interior surface and a first exterior surface;

a second portion having a second interior surface and a second exterior surface; and a third portion that couples together the first portion and the second portion via:

a first junction of the first portion with the third portion and a second junction of the second portion with the third portion;

wherein:

the first and second junctions with the third portion preclude the first and second portions from freely hinging relative to each other;

first ends of the first and second portions are located opposite and away from the third portion;

a second end of the first portion is coupled to the third portion via the first junction;

a second end of the second portion is coupled to the third portion via the second junction;

the first, second, and third portions, and the first and second junctions, comprise a continuous semi-rigid foam material;

in a relaxed configuration, when the article does not contact the device, the article comprises:

a first distance between:

a first section of the first interior surface proximate to the first end of the first portion and a second section of the second interior surface proximate to the first end of the second portion;

a second distance, greater than the first distance, between:

a third section of the first interior surface proximate to the second end of the first portion and a fourth section of the second interior surface proximate to the second end of the second portion;

and an acute angle relationship maintained between the first and second portions by the first and second junctions with the third portion;

when the device comprises a laptop computer:

the first distance is less than a thickness of the device; and the second distance is greater than or equal to the thickness of the device;

in a support configuration:

the second portion comprises a substantially horizontal position over a horizontal support surface;

the second junction maintains the third portion non-parallel to the horizontal support surface; and the first and second junctions with the third portion maintain the first and second portions at a horizontal acute relationship relative to each other;

when the article stores the device between the first and second portions, with the device extended from the first section to the third section and from the second section to the fourth section:

the first and second sections pinch an opposite end of the device therebetween, being urged towards each other by the first and second junctions with the third portion; and the first section is spaced apart from the second section by a third distance greater than the first distance and substantially equal to the thickness of the device;

an inner area of the first interior surface of the first portion comprises a first inner perimeter edge so dimensioned as to extend to at least an outer perimeter edge of the device, throughout the outer perimeter edge of the device, when the article stores the device between the first and second portions;

an inner area of the second interior surface of the second portion comprises a second inner perimeter edge so dimensioned as to extend to at least the outer perimeter edge of the device, throughout the outer perimeter edge of the device, when the article stores the device between the first and second portions;

in a vertical configuration, where the third portion lies over the horizontal support surface and supports the article over the horizontal support surface, the first and second junctions with the third portion maintain a vertical acute relationship between the first and second portions such that the first and second portions extend:

upwards relative to the horizontal support surface;

to the first ends of the first and second portions away from the horizontal support surface; and to the second ends of the first and second portions towards the horizontal support surface;

and the first and second junctions with the third portion automatically transition the article back to the relaxed configuration, reestablishing the first distance between the first and second sections, when or after the device is removed from the article while the article remains in the vertical configuration.

2. The article of claim 1, further comprising:

at least one of:

a first handle coupled proximate to at least one of:

the first end of the first portion; or the second end of the first portion;

or a second handle coupled proximate to at least one of:

the first end of the second portion; or the second end of the second portion.

3. The article of claim 1, further comprising:

at least one support mechanism coupled to an exterior of the third portion and configured to support the article while in the vertical configuration.

4. The article of claim 1, wherein the first and second portions are substantially planar.

5. The article of claim 1, wherein:

at least one of the first or second exterior surfaces further comprises:

a recess configured to at least partially accommodate therewithin a portion of an outer perimeter of the device when the device is supported over the at least one of the first or second exterior surfaces.

6. The article of claim 1, wherein:

at least one of the first or second exterior surfaces further comprises:

first and second support sections; and a trough surface extending between the first and second support sections completely across the at least one of the first or second exterior surfaces;

the trough surface is sunk, relative to the first and second support sections, into the at least one of the first or second exterior surfaces; and the trough surface is configured to permit venting between the article and the device when the device is supported over the trough surface by the first and second support sections.

7. The article of claim 1, wherein:

the first portion is thicker at the third section than at the first section;

the second portion is thicker at the fourth section than at the second section;

the first, second, and third portions are continuous and integral with each other.

8. The article of claim 1, wherein:

the first and second junctions with the third portion preclude the first, second, and third portions from being coplanar to each other.

9. The article of claim 1, wherein:

when the article is in the relaxed configuration, with the second portion at the substantially horizontal position over the horizontal support surface:

the first section of the first interior surface and the second section of the second interior surface remain distanced apart from each other.

10. An article to support a device, the article comprising:

a first portion;

a second portion substantially opposite the first portion; and a hinge portion that couples together the first portion and the second portion via:

a first junction of the first portion with the hinge portion and a second junction of the second portion with the hinge portion;

wherein:

the first and second junctions with the hinge portion preclude the first and second portions from freely hinging relative to each other;

a first end of the first portion is located opposite and away from the hinge portion;

a first end of the second portion is located opposite and away from the hinge portion;

a second end of the first portion, opposite the first end of the first portion, is coupled to the hinge portion via the first junction;

a second end of the second portion, opposite the first end of the second portion, is coupled to the hinge portion via the second junction;

a surface area of the first portion is substantially equal to a surface area of the second portion;

when the article is in a support position, with the second portion resting over a horizontal support surface:

the second junction maintains the hinge portion non-parallel to the horizontal support surface; and the first and second junctions and the hinge portion align the first and second portions at an acute angle relationship relative to each other;

when the article is in a vertical position, where the hinge portion lies over the horizontal support surface and supports the article over the horizontal support surface, the first and second junctions with the hinge portion maintain a vertical acute relationship between the first and second portions such that the first and second portions extend:

upwards relative to the horizontal support surface;

to the first ends of the first and second portions away from the horizontal support surface; and to the second ends of the first and second portions towards the horizontal support surface.

11. The article of claim 10, wherein:

when the device comprises a laptop computer:

an inner area of the first portion comprises a first inner perimeter edge so dimensioned as to extend to at least an outer perimeter edge of the device throughout the outer perimeter edge of the device when the device is stored between the first and second portions; and an inner area of the second portion comprises a second inner perimeter edge so dimensioned as to extend to at least the outer perimeter edge of the device throughout the outer perimeter edge of the device when the device is stored between the first and second portions.

12. The article of claim 10, further comprising:

at least one of:

a first handle coupled to at least one of the first end or the second end of the first portion; or a second handle coupled to at least one of the first end or the second end of the second portion.

13. The article of claim 10, further comprising:

at least one support mechanism coupled to the hinge portion;

wherein:

the at least one support mechanism is configured to support the article while in the vertical position.

14. The article of claim 10, wherein the first and second portions comprise substantially planar portions.

15. The article of claim 10, wherein each of the first and second portions comprise a cushioning material.

16. The article of claim 10, wherein:

an exterior surface of at least one of the first or second portions further comprises:

a recess configured to at least partially secure therewithin an outer perimeter of the device when the device is supported over the exterior surface.

17. The article of claim 10, wherein:

an exterior surface of at least one of the first or second portions further comprises:

first and second support sections; and a trough surface extending completely across the exterior surface between the first and second support sections of the exterior surface;

the trough surface is sunk, relative to the first and second support sections, into the exterior surface; and the trough surface is configured to permit venting between the article and the device when the device is supported over the trough surface by the first and second support sections.

18. The article of claim 10, wherein:

the first portion increases in thickness towards the hinge portion;

the second portion increases in thickness towards the hinge portion; and the first, second, and hinge portions are continuous and integral with each other.

19. The article of claim 10, wherein:

the first and second portions are joined together substantially continuously by the first and second junctions with the hinge portion; and while the article is in the vertical position:

the first portion is maintained extended upwards by its the first junction with the hinge portion; and the second portion is maintained extended upwards by its the second junction with the hinge portion.

20. The article of claim 10, wherein:

the first, second, and hinge portions, and the first and second junctions, comprise a continuous semi-rigid cushioning material.

21. The article of claim 10, wherein:

the device comprises a laptop computer; and in the vertical position, when the device is stored between the first and second portions:

the first and second junctions with the hinge portion urge the first and second portions towards each other to pinch, between the first and second portions, a thickness of an end of the device located opposite the hinge portion.

22. The article of claim 10, wherein:

the first and second junctions with the hinge portion preclude the first, second, and hinge portions from being coplanar to each other.

23. The article of claim 10, wherein:

in a relaxed configuration, where the article does not contact the device and the second portion rests over the horizontal support surface, the article comprises:

a first distance separating the first end of the first portion and the first end of the second portion from each other, the first distance upheld by the first and second junctions; and a second distance, greater than the first distance, between the second end of the first portion and the second end of the second portion.

24. A method for providing an article to support a device, the method comprising:

providing a first portion of the article having a first interior surface and a first exterior surface;

providing a second portion of the article having a second interior surface and a second exterior surface; and providing a third portion of the article that couples together the first portion and the second portion via:

a first junction of the first portion with the third portion and a second junction of the second portion with the third portion;

wherein:

the first and second junctions with the third portion preclude the first and second portions from freely hinging relative to each other;

first ends of the first and second portions are located opposite and away from the third portion;

a second end of the first portion is coupled to the third portion via the first junction;

a second end of the second portion is coupled to the third portion via the second junction;

the first, second, and third portions, and the first and second junctions, comprise a continuous semi-rigid foam material;

in a relaxed configuration, when the article does not contact the device, the article comprises:

a first distance between:

a first section of the first interior surface proximate to the first end of the first portion and a second section of the second interior surface proximate to the first end of the second portion;

a second distance, greater than the first distance, between:

a third section of the first interior surface proximate to the second end of the first portion and a fourth section of the second interior surface proximate to the second end of the second portion;

and an acute angle relationship maintained between the first and second portions by the first and second junctions with the third portion;

in a support configuration:

the second portion comprises a substantially horizontal position over a horizontal support surface;

the second junction maintains the third portion non-parallel to the horizontal support surface; and the first and second junctions with the third portion maintain the first and second portions at a horizontal acute relationship relative to each other;

when the article stores the device between the first and second portions, with the device extended from the first section to the third section and from the second section to the fourth section:

the first and second sections pinch an opposite end of the device therebetween, being urged towards each other by the first and second junctions with the third portion; and the first section is spaced apart from the second section by a third distance greater than the first distance and substantially equal to the thickness of a device;

in a vertical configuration, where the third portion lies over the horizontal support surface and supports the article over the horizontal support surface, the first and second junctions with the third portion maintain a vertical acute relationship between the first and second portions such that the first and second portions extend:

upwards relative to the horizontal support surface;

to the second ends of the first and second portions towards the horizontal support surface; and to the first ends of the first and second portions away from the horizontal support surface;

and the first and second junctions with the third portion automatically transition the article back to the relaxed configuration, reestablishing the first distance between the first and second sections, when or after the device is removed from the article while the article remains in the vertical configuration.

25. The method of claim 24, further comprising:

providing at least one of:

a first handle coupled proximate to the first end of the first portion; or a second handle coupled proximate to the first end of the second portion.

26. The method of claim 24, further comprising:

providing at least one support mechanism coupled to an exterior of the third portion and configured to support the article while in the vertical configuration.

27. The method of claim 24, wherein the first and second portions are substantially planar.

28. The method of claim 24, further comprising:

providing a recess located in at least one of the first or second exterior surfaces;

wherein the recess is configured to at least partially accommodate therewithin a portion of an outer perimeter of the device when the device is supported over the at least one of the first or second exterior surfaces.

29. The method of claim 24, further comprising:

providing a trough located in at least one of the first or second exterior surfaces;

wherein the trough is configured to permit venting between the article and the device when the device is supported over the at least one of the first or second exterior surfaces.

30. The method of claim 24, wherein:

the first portion is thicker at the third section than at the first section;

the second portion is thicker at the fourth section than at the second section; and the first, second, and third portions are continuous and integral with each other.

31. The method of claim 24, wherein:

the first and second junctions with the third portion preclude the first, second, and third portions from being coplanar to each other.

32. The method of claim 24, wherein:

when the article is in the relaxed configuration, with the second portion at the substantially horizontal position over the horizontal support surface:

the first section of the first interior surface and the second section of the second interior surface remain distanced apart from each other.

* * * * *